US009708944B2

(12) United States Patent
Holdenried et al.

(10) Patent No.: US 9,708,944 B2
(45) Date of Patent: Jul. 18, 2017

(54) APPARATUS FOR SUPPLYING A COOLANT TO A HEAT EXCHANGER, PREFERABLY FOR AN EXHAUST GAS COOLER OF AN INTERNAL COMBUSTION ENGINE OF A MOTOR VEHICLE

(71) Applicant: MAHLE International GmbH, Stuttgart (DE)

(72) Inventors: Jens Holdenried, Ditzingen (DE); Cecilia Marola, Stuttgart (DE)

(73) Assignee: MAHLE INTERNATIONAL GMBH, Stuttgart (DE)

( * ) Notice: Subject to any disclaimer, the term of this patent is extended or adjusted under 35 U.S.C. 154(b) by 0 days.

(21) Appl. No.: 14/860,783

(22) Filed: Sep. 22, 2015

(65) Prior Publication Data

US 2016/0084128 A1 Mar. 24, 2016

(30) Foreign Application Priority Data

Sep. 22, 2014 (DE) ..... 10 2014 219 078

(51) Int. Cl.

| | |
|---|---|
| ***F01N 3/02*** | (2006.01) |
| ***F28F 9/02*** | (2006.01) |
| ***F01N 3/04*** | (2006.01) |
| ***F02M 26/32*** | (2016.01) |

(52) U.S. Cl.

CPC ..... *F01N 3/0205* (2013.01); *F01N 3/04* (2013.01); *F02M 26/32* (2016.02); *F28F 9/0258* (2013.01); *F01N 2260/024* (2013.01)

(58) Field of Classification Search

CPC ..... F02B 29/0475; F02B 29/0493; F02B 29/0443; F02B 29/0462; F01P 2060/02

USPC ..... 60/320, 599; 123/563

See application file for complete search history.

(56) References Cited

U.S. PATENT DOCUMENTS

| | | | | |
|---|---|---|---|---|
| 4,071,403 | A | 1/1978 | Andrews et al. | |
| 2007/0187080 | A1 * | 8/2007 | Sonoda | F28D 1/05366 165/174 |
| 2010/0288640 | A1 * | 11/2010 | Jachuck | B01J 4/007 204/519 |

FOREIGN PATENT DOCUMENTS

| | | | | |
|---|---|---|---|---|
| DE | 1815047 | U * | 7/1960 | |
| DE | 1 815 047 | A | 6/1970 | |
| DE | 29714361 | U1 * | 12/1997 | F28D 20/0039 |
| DE | EP 1363012 | A1 * | 11/2003 | F16K 1/222 |
| DE | 10 2004 027 479 | B3 | 9/2005 | |
| DE | WO 2007028463 | A1 * | 3/2007 | F28D 1/05366 |
| DE | 10 2006 051 000 | A1 | 7/2007 | |
| DE | 102010012192 | A1 * | 9/2011 | F28F 9/0246 |
| DE | 10 2012 221 325 | A1 | 5/2014 | |

(Continued)

OTHER PUBLICATIONS

Machine Translation DE1815047, Translated on Aug. 22, 2016.*

(Continued)

*Primary Examiner* — Patrick Maines

(74) *Attorney, Agent, or Firm* — Paul D. Strain, Esq.; Strain & Strain PLLC

(57) ABSTRACT

The invention relates to an apparatus for supplying a coolant to a closed fluid circuit, preferably for an exhaust gas cooler of an internal combustion engine of a motor vehicle, comprising a connecting stub, wherein the connecting stub is designed for insertion into a coolant connection, wherein a flow-directing device, which is of projection-like design, for the coolant is integrated in the interior of the connecting stub.

8 Claims, 6 Drawing Sheets

(56) References Cited

FOREIGN PATENT DOCUMENTS

| | | | | |
|---|---|---|---|---|
| DE | 102014202447 | | * | 8/2015 |
| EP | 2 728 155 | A1 | | 5/2014 |
| FR | 2 280 953 | A1 | | 2/1976 |
| JP | 2013-53620 | A | | 3/2013 |
| KR | 100 748 756 | B1 | | 8/2007 |
| WO | WO 2014/072274 | A1 | | 5/2014 |

OTHER PUBLICATIONS

European Search Report, Application No. EP 15184620.1, Feb. 1, 2016, 6 pgs.
German Search Report, Application No. DE 10 2014 219 078.9, Jun. 3, 2015, 8 pgs.

* cited by examiner

APPARATUS FOR SUPPLYING A COOLANT TO A HEAT EXCHANGER, PREFERABLY FOR AN EXHAUST GAS COOLER OF AN INTERNAL COMBUSTION ENGINE OF A MOTOR VEHICLE

CROSS-REFERENCE TO RELATED PATENT APPLICATIONS

This application is based upon and claims the benefit of priority from prior German Patent Application No. 10 2014 219 078.9, filed Sep. 22, 2014, the entire contents of which are incorporated herein by reference in their entirety.

TECHNICAL FIELD

The invention relates to an apparatus for supplying a coolant to a heat exchanger, preferably for an exhaust gas cooler of an internal combustion engine of a motor vehicle, comprising a connecting stub.

PRIOR ART

Exhaust gas coolers as used in motor vehicles have the task of cooling hot exhaust gas from internal combustion engines so that said cooled exhaust gas can be mixed again with the intake air. So that the thermodynamic efficiency of the internal combustion engine does not drop too severely, cooling to a low level should be aimed at. This principle is known in general as cooled exhaust gas recirculation and is used in order to achieve a reduction in pollutants in the exhaust gas.

Very high exhaust gas temperatures of the internal combustion engine may cause the coolant to boil especially in the area directly behind the gas entry of the exhaust gas cooler, which may have negative effects on the service life of the exhaust gas cooler. The risk of boiling may be countered to a limited extent by an increase in the throughput of coolant. However, the quantity of coolant flowing through the exhaust gas cooler is limited technically by the coolant-side flow resistance of the exhaust gas cooler.

DE 10 2004 027 479 B3 discloses a system consisting of a valve and a protective cap, in which the valve is connected at one end to a line of a closed fluid circuit. A sealing body is arranged here between the valve and the protective cap in order to prevent dirt particles from penetrating the coolant.

DE 10 2012 221 325 A1 discloses a winding head cooling, wherein two cooling circuit components which cool an electric machine are connected by means of a "plug and seal element".

SUMMARY OF THE INVENTION, OBJECT, SOLUTION, ADVANTAGES

It is the object of the invention to provide an apparatus for supplying a coolant to a heat exchanger, preferably to an exhaust gas cooler of an internal combustion engine of a motor vehicle, in which the available coolant flow rate is used efficiently and a risk of the coolant boiling is reduced.

This object is achieved by an apparatus according to the features of claim 1.

An exemplary embodiment of the invention relates to an apparatus for supplying a coolant to a heat exchanger, preferably to an exhaust gas cooler of an internal combustion engine of a motor vehicle and to a connecting stub, wherein a flow-directing device, which is of projection-like design, for the coolant is integrated in the interior of the connecting stub. By means of such a flow-directing device, the coolant, even as it enters the heat exchanger, is distributed as uniformly as possible over the cross section of the components of the heat exchanger in order then to be able to flow in parallel in a uniformly distributed manner between the heat exchanger pipes which conduct the hot exhaust gas, wherein the flow-directing device is formed approximately centrally on the inner wall, in a manner projecting into an interior of the connecting stub, and a contour of the flow-directing device runs in a direction of longitudinal extent of the connecting stub in a manner rising in the direction of the heat exchanger. Since said uniform distribution takes place in the area directly behind the entry of the fluid to be cooled, a risk of the coolant boiling is reduced. Uniform distribution is furthermore intended to be understood here as meaning a uniform coolant flow velocity of the coolant flowing into the heat exchanger.

The connecting stub here is advantageously designed as a "plug and seal element" for insertion into a coolant connection.

According to the invention, the flow-directing device is formed approximately centrally on the inner wall, in a manner projecting into an interior of the connecting stub, wherein a contour of the flow-directing device runs in a direction of longitudinal extent of the connecting stub in a manner rising in the direction of the heat exchanger. Such a ski-jump-shaped flow-directing device which ends on both sides with the connecting stub produces a widely fanned-out guidance of the coolant in the direction of the heat exchanger and also to the sides within the connecting stub. The acceleration of the flow takes place here approximately constantly and approximately over the entire length of the connecting stub.

In one refinement, an axial rise of the contour of the flow-directing device runs linearly in the direction of the heat exchanger. Such a linear rise of the flow-directing device which is integrated in the connecting stub structurally permits the connection of a line which can be branched in a plurality of directions.

In an alternative, the axial rise of the contour of the flow-directing device in the direction of the heat exchanger runs in accordance with a power function. Such a course assists the constant acceleration of the flow of coolant and therefore reduces the risk of boiling of the coolant.

In one embodiment, the axial rise of the contour of the flow-directing device runs parabolically. Such a refinement permits the reduction in requirement of coolant in order to avoid boiling.

In a variant, the contour of the flow-directing device is of approximately mirror-symmetrical design in the radial direction of the connecting stub, wherein a curvature adjoins the inner wall of the connecting stub on both sides with respect to a centrally formed maximum. Said curvatures also assist a uniform distribution of the coolant flow velocity.

In an advantageous manner, the respective curvature runs concavely from the maximum of the flow-directing device to the inner wall of the connecting stub. Such a connecting stub in a coolant connection permits an optimized connection which is particularly efficient in terms of construction space to the exhaust gas cooler without additional tubes or pipes directly to the internal combustion engine.

In a development, the radial orientation of the contour of the flow-directing device is determined depending on a width of the block containing the fluid circuit. Owing to the fact that the coolant entry in the coolant connection is narrower than the block, a bell-shaped distribution of the coolant is normally produced, the coolant having a high flow velocity in the center, decreasing to the sides. These differences in the flow velocity are dissipated by the apparatus according to the invention. The flow-directing device distributes the inflowing coolant at a virtually constant coolant flow velocity.

In a refinement, the connecting stub has an approximately round cross section and is arranged directly on the heat exchanger.

Further advantageous refinements are described by the description below of the figures and by the dependent claims.

BRIEF DESCRIPTION OF THE FIGURES OF THE DRAWING

The invention is explained in more detail below on the basis of at least one exemplary embodiment with reference to the figures of the drawing, in which.

PREFERRED EMBODIMENT OF THE INVENTION

Figure 1:
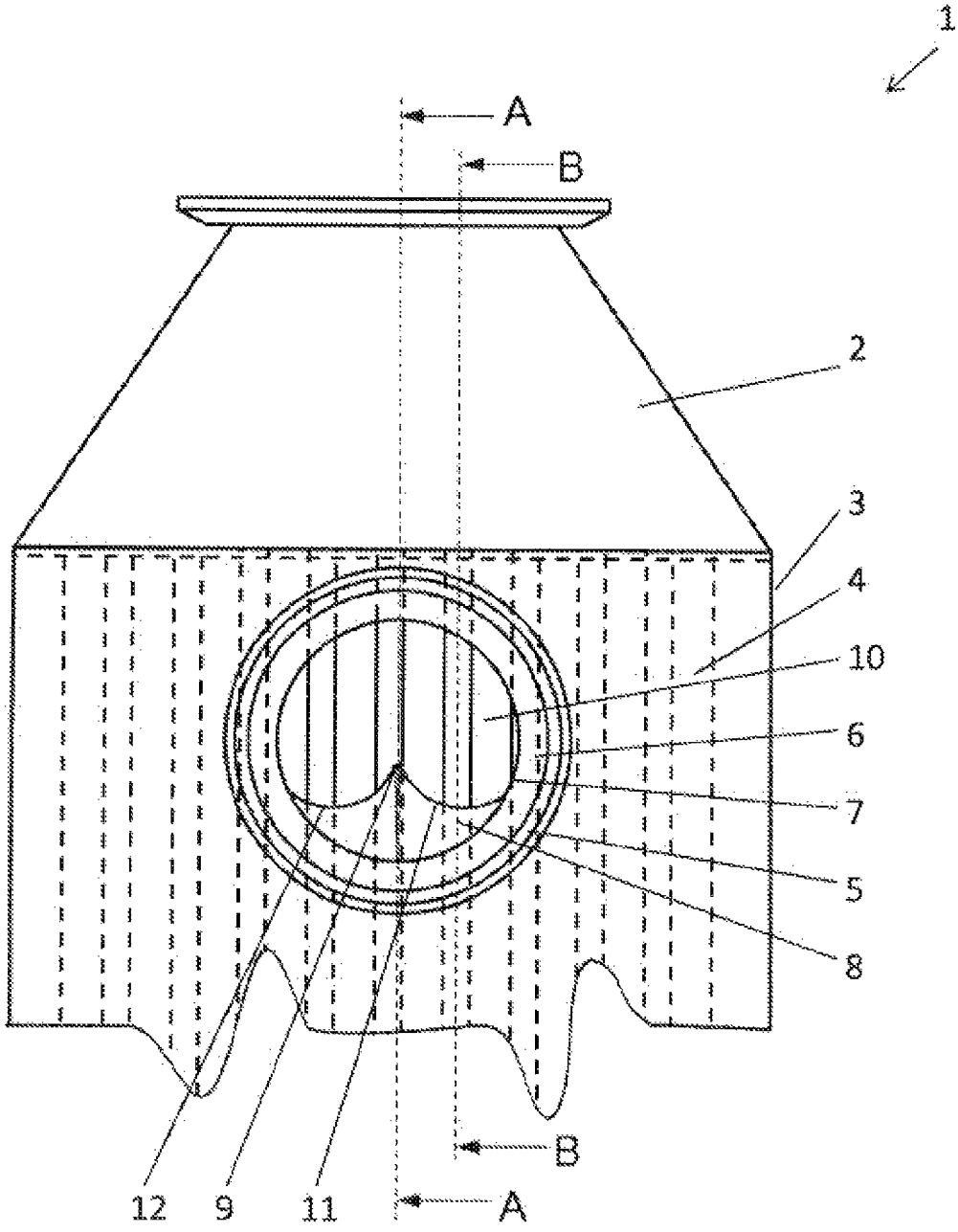
FIG. 1 shows a first exemplary embodiment of the apparatus according to the invention at the entry region of an exhaust gas cooler.

FIG. 1 shows an entry region for exhaust gas and coolant of an exhaust gas cooler 1, as is used in internal combustion engines, preferably diesel engines, in motor vehicles in order to cool the hot exhaust gas output by the internal combustion engine so that said cooled exhaust gas can be mixed again with the intake air of the internal combustion engine. Such an exhaust gas cooler 1 consists of a diffuser 2 to which a cooler block 3 is connected. Fastened directly to the cooler block 3, which has a plurality of pipes 4 which run parallel to one another and in which the exhaust gas produced by the internal combustion engine is conducted is a coolant connection 5 through which a coolant is introduced into the cooler block 3 in order to cool the pipes 4 through which the hot exhaust gas flows. In the opposite direction to the cooler block 3, the coolant connection 5 is connected to a line (not illustrated further).

A connecting stub 6 is clamped into the coolant connection 5, for example in the form of a plug and seal element. Such a connecting stub 6 is not only simply insertable into the coolant connection 5 on the cooler block of the exhaust gas cooler 1 but is advantageously and optionally also of self-sealing design, and therefore coolant cannot escape. The connecting stub 6 has a round cross section and contains a flow-directing device 8 on the inner wall 7 thereof. The flow-directing device 8 is of projection-like design and in the center has a maximum 9 which projects into the interior 10 of the connecting stub 6. Starting from the maximum 9, the flow-directing device 8 has radially formed curvatures 11, 12 which run to the inner wall of the connecting stub 6. Said curvatures 11, 12 are formed symmetrically here with respect to the maximum 9 and run concavely.

Figure 2:
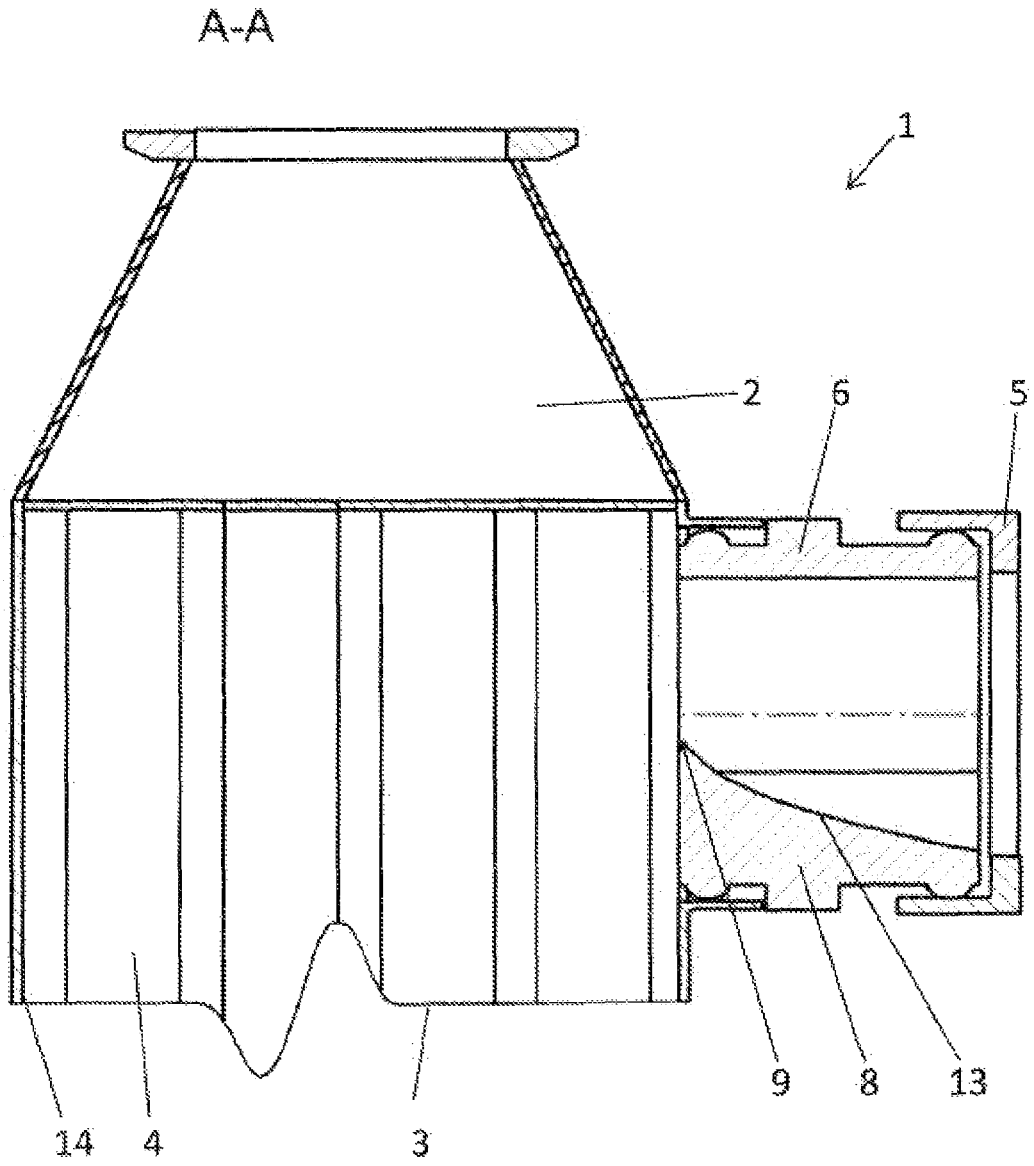
FIG. 2 shows a section A-A through the apparatus according to the invention and the entry region of the exhaust gas cooler according to FIG. 1.

A section A-A of the exhaust gas cooler 1 is illustrated in FIG. 2. It is apparent therefrom that the coolant connection 5 surrounds the connecting stub 6, wherein the flow-directing device 8, in the axial extent 13 thereof starting from the cooler block 3 of the exhaust gas cooler 1 as far as the coolant connection 5, which is arranged on the internal combustion engine, preferably on the cylinder head of the internal combustion engine, has a parabolic contour which decreases from the cooler block 3 to the coolant connection 5.

Figure 3:
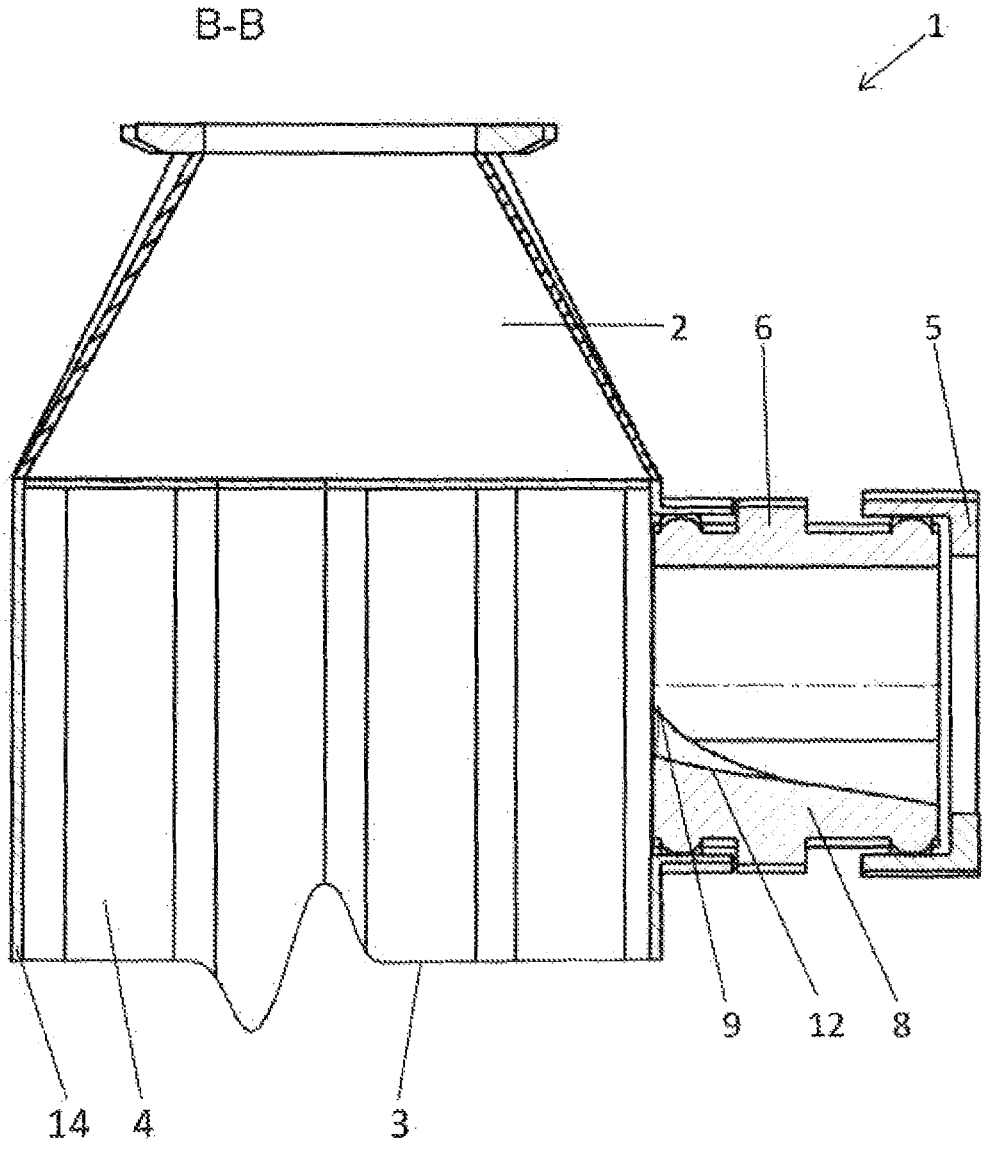
FIG. 3 shows a section B-B through the apparatus according to the invention and the entry region of the exhaust gas cooler according to FIG. 1.

As is apparent from FIG. 3 in the section B-B, the maximum 9 constitutes the highest elevation of the flow-directing device 8, wherein the curvatures 11, 12 of the flow-directing device 8 also decrease from the cooler block 3 to the coolant connection 5.

Figure 4:
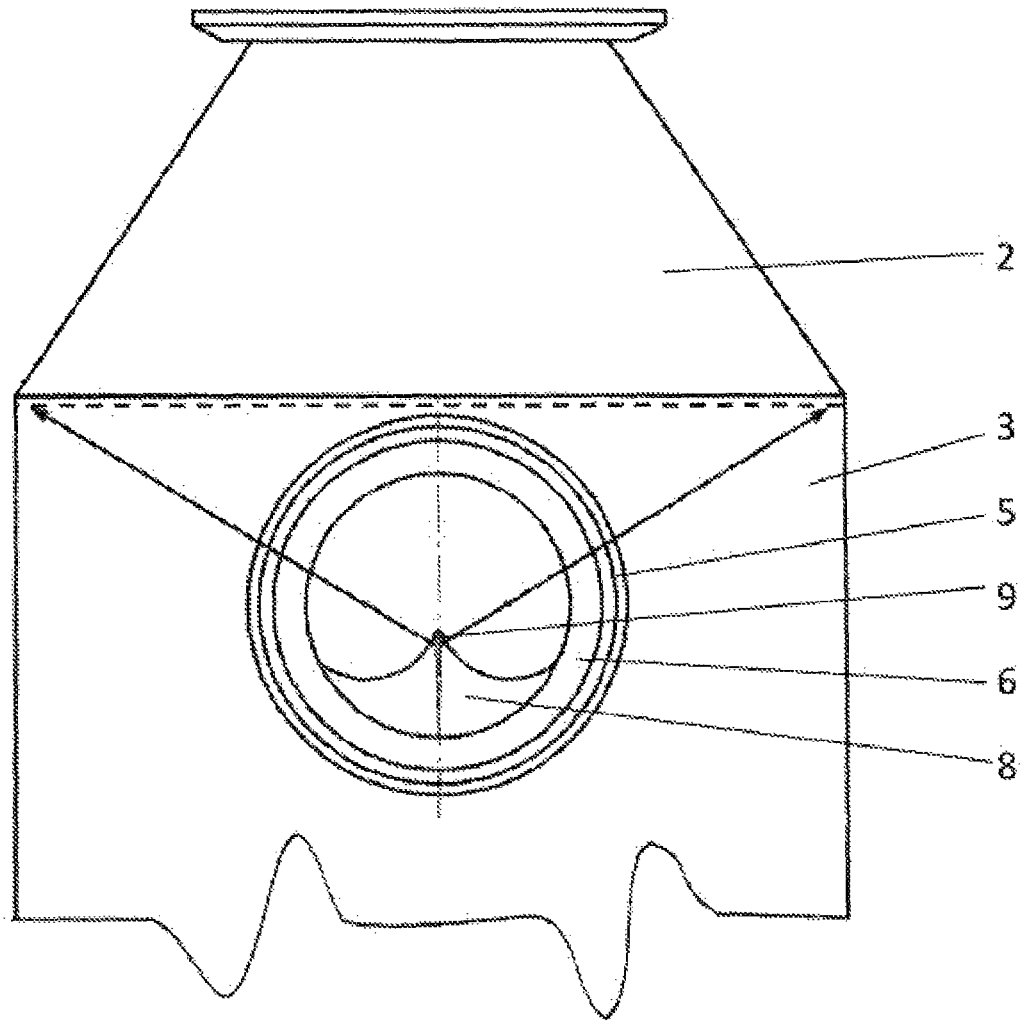
FIG. 4 shows a second exemplary embodiment of the apparatus according to the invention at the entry region of an exhaust gas cooler.
Figure 5:
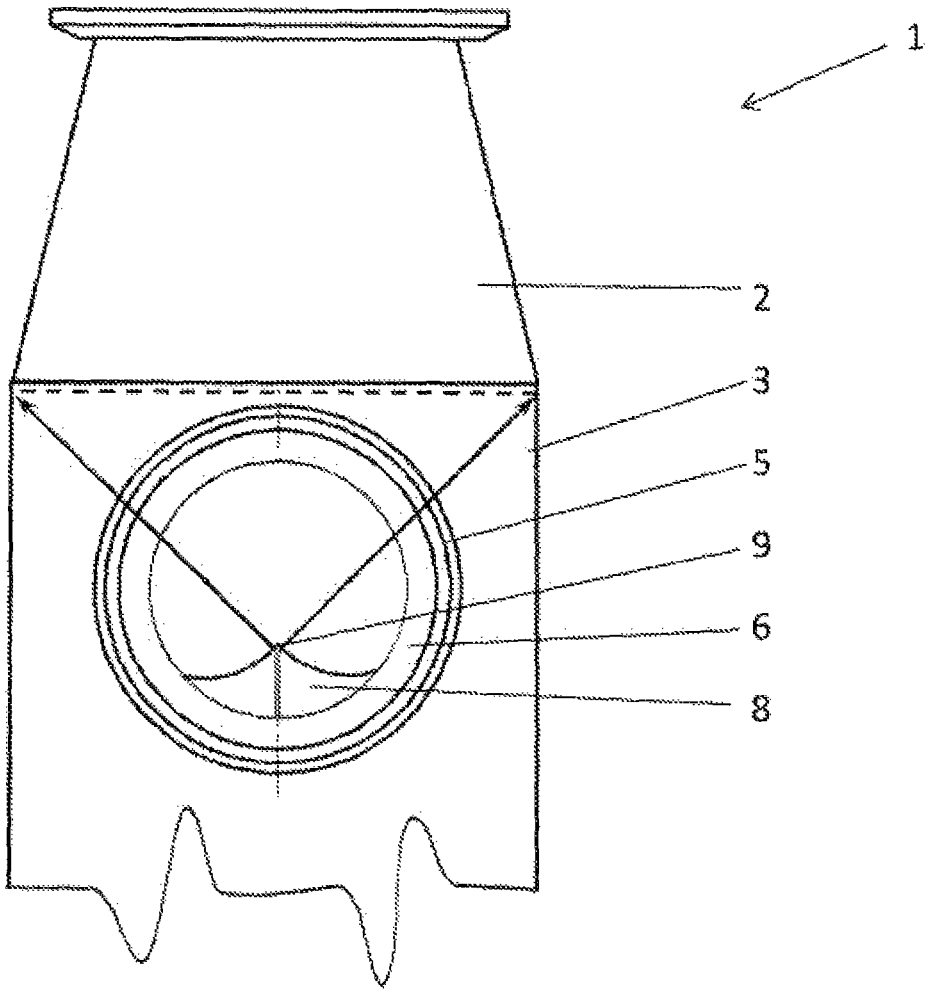
FIG. 5 shows a third exemplary embodiment of the apparatus according to the invention at the entry region of an exhaust gas cooler.
Figure 6:
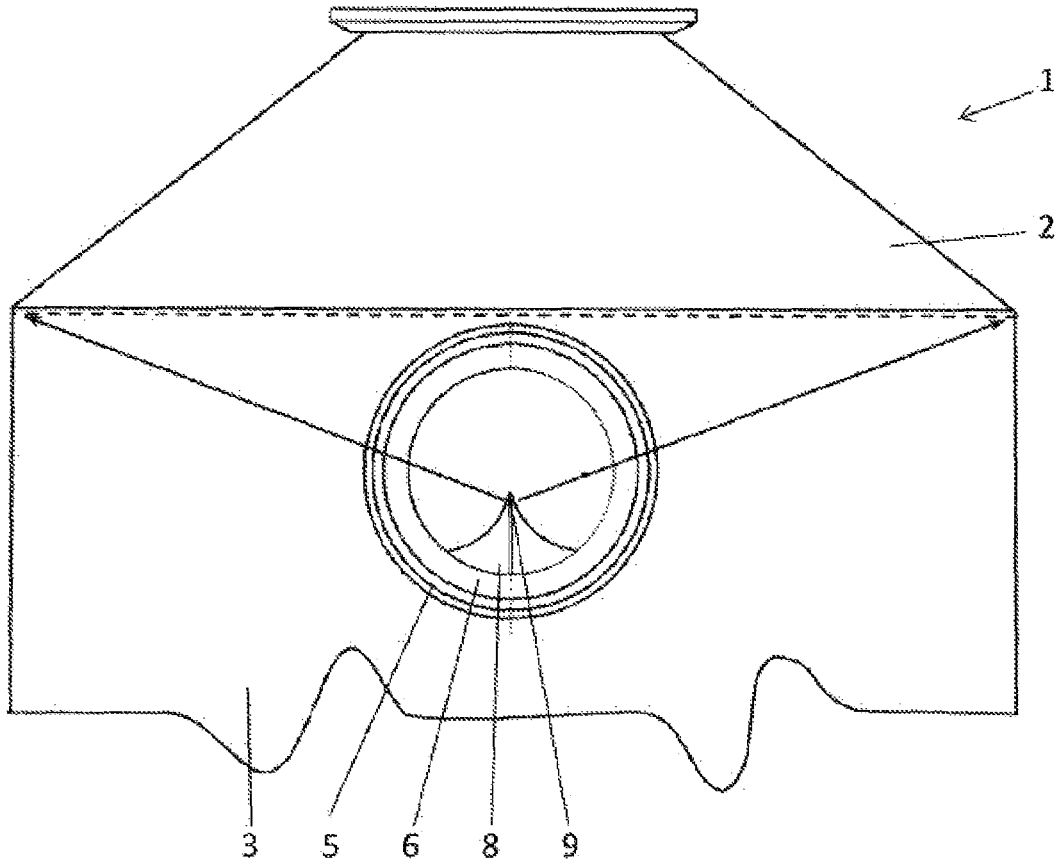
FIG. 6 shows a fourth exemplary embodiment of the apparatus according to the invention at the entry region of an exhaust gas cooler.

The flow-directing device 8 is optimized in the radial orientation thereof in such a manner that a certain ratio of the width of the coolant block 3 to the average width of said flow-directing line is provided in order in each case always to ensure an optimum flow velocity of the coolant in relation to the gas flow rate through the exhaust gas cooler 1 and to ensure that only a minimum requirement of coolant has to be provided in order to avoid boiling of the coolant. FIG. 4 shows an adaptation of the radial average width of the flow-directing device 8 to the block width of the coolant block 3 of approximately 3. According to FIG. 5, the coolant distribution is adapted to the width of the coolant block 3 to the effect that the block width to the average width of the flow-directing device 8 is approximately 2, while, in FIG. 6, the block width to the average width is approximately 5.

The connecting stub 6 is designed in such a manner that it reaches together with the flow-directing device 8 approximately as far as the inner edge of a housing 14 of the coolant block 3 and, at a maximum axial displacement, reaches to 2 mm in front of the inner edge of the housing 14. A compensation of manufacturing tolerances and thermal expansion is therefore possible, in particular if it can advantageously also be tilted by 2°.

The described solution shows a retrofitable coolant connection in which is integrated a flow-directing device which permits compensation of manufacturing tolerances and thermal expansions. The effect depends on the respective projection of the flow-directing device 8 into the connecting stub 6.

The invention claimed is:

1. An apparatus for supplying a coolant to a heat exchanger comprising a connecting stub, wherein the connecting stub is designed for insertion into a coolant connection, wherein a projection-like flow-directing device for the coolant is integrated in an interior of the connecting stub, wherein the flow-directing device is formed approximately centrally on an inner wall, in a manner projecting into an interior of the connecting stub, and a contour of the flow-directing device runs in a direction of longitudinal extent of the connecting stub in a manner rising in a direction of the heat exchanger, wherein the contour of the flow-directing device is of mirror-symmetrical design in a radial direction of the connecting stub, wherein a respective curvature adjoins the inner wall of the connecting stub on both sides with respect to a centrally formed maximum.

2. The apparatus according to claim 1, wherein the connecting stub is designed as a plug and seal element.

3. The apparatus according to claim 1, wherein an axial rise of the contour of the flow-directing device runs linearly in the direction of the heat exchanger.

4. The apparatus according to claim 1, wherein an axial rise of the contour of the flow-directing device in the direction of the heat exchanger runs at least in accordance with a power function.

5. The apparatus according to claim 4, wherein the axial rise of the contour of the flow-directing device runs parabolically.

6. The apparatus according to claim 1, wherein the respective curvature runs concavely from the maximum of the flow-directing device to the inner wall of the connecting stub.

7. The apparatus according to claim 1, wherein a radial orientation of the contour of the flow-directing device is determined depending on a width of a block of the heat exchanger.

8. The apparatus according to claim 1, wherein the connecting stub has a circular or round cross section and is inserted in the coolant connection.

* * * * *